United States Patent [19]

Sunden et al.

[11] 4,388,150

[45] Jun. 14, 1983

[54] PAPERMAKING AND PRODUCTS MADE THEREBY

[75] Inventors: Olof Sunden, Thonon, France; Per G. Batelson, Lilla Edet, Sweden; Hans E. Johansson, Kungälv, Sweden; Hans M. Larsson; Per J. Svending, both of Gothenburg, Sweden

[73] Assignee: Eka Aktiebolag, Surte, Sweden

[21] Appl. No.: 238,635

[22] Filed: Feb. 26, 1981

[30] Foreign Application Priority Data

May 28, 1980 [SE] Sweden ..... 8003948

[51] Int. Cl.[3] ..... D21H 3/28; D21H 3/66

[52] U.S. Cl. ..... 162/175; 162/181.6

[58] Field of Search ..... 162/181.6, 175, 190

[56] References Cited

U.S. PATENT DOCUMENTS

| | | | |
|---|---|---|---|
| 2,647,158 | 7/1953 | Booth | 162/181.6 |
| 2,865,743 | 12/1958 | Weisgerber | 162/181.6 |
| 3,224,927 | 12/1965 | Brown et al. | 162/181.6 |
| 3,227,607 | 1/1966 | Mays et al. | 162/181.6 |
| 3,592,834 | 7/1971 | Buckman et al. | 260/448.8 A |
| 3,721,575 | 3/1973 | Jarowenko et al. | 162/175 |
| 3,737,370 | 6/1973 | Jarowenko et al. | 162/175 |
| 3,779,912 | 12/1973 | Redmore et al. | 162/190 |

FOREIGN PATENT DOCUMENTS

| | | |
|---|---|---|
| 2802861 | 8/1978 | Fed. Rep. of Germany . |
| 2412452 | 4/1980 | Fed. Rep. of Germany . |
| 49427 | 2/1975 | Finland . |
| 54805 | 11/1978 | Finland . |

OTHER PUBLICATIONS

Casey, *Pulp and Paper*, vol. II, (1960), pp. 746, 846, 1014, 1178, 1179.

Noreus, "The Use of Activated Silica in the Coagulation of Highly Colored Water", TAPPI, vol. 120, No. 11, (Mar. 1945), pp. 101-103.

*Primary Examiner*—Peter Chin

*Attorney, Agent, or Firm*—Luedeka & Neely

[57] ABSTRACT

In making paper from an aqueous papermaking stock a binder comprising colloidal silicic acid and cationic starch is added to the stock for improving the paper or the retention of the stock components, or is added to the white water for reducing the pollution problems or recovering values from the white water.

The cationic starch of the binder has a degree of substitution of not less than 0.01, and the weight ratio of cationic starch to $SiO_2$ is between 1:1 and 25:1.

37 Claims, 22 Drawing Figures

PAPER, GRAMMAGE-ASH-CHINA CLAY
C.S. level 1
C.S. level 2
C.S. level 3
Grammage
Brake
Brake
China clay
Ash
100
50
0
grams/meter²
1500
1600
1700
Time of run

TENSILE INDEX
METHOD: SCAN P16:76

Nm/g
40
30
20
Level 2
Level 1
Prior to
c.s.addition
10
20
30
40 %
Ash content

TENSILE INDEX
METHOD: SCAN P16:76

Nm/g
40
30
20
Level 2
Level 1
Prior to
c.s.addition
60
50
40
30
20 %
Chemical pulp content

TEAR INDEX
METHOD: SCAN P11:73 mNm²/g
15
10
5
Prior to c.s. addition
Level 1
Level 2
10
20
30
40 %
Ash content

TEAR INDEX
METHOD: SCAN P11:73 mNm²/g
15
10
5
Prior to c.s. addition
Level 1
Level 2
60
50
40
30
20
%
Chemical pulp content

PAPERMAKING AND PRODUCTS MADE THEREBY

The present invention relates generally to papermaking processes and the products made thereby, and more particularly, to the use of a binder in a papermaking process, the binder comprising a complex of cationic starch and colloidal silicic acid to produce a paper having increased strength and other characteristics. Such a binder, in addition, also effects highly improved levels of retention of added mineral materials as well as papermaking fines. Moreover, various of the features of the invention may be employed to effect clarification of the white water resulting from a papermaking process.

At the present time, the papermaking industry is plagued with a number of serious problems. First, the price of cellulosic pulp has escalated materially and high quality pulp is in relatively short supply. Second, various problems including the problems inherent in the disposal of papermaking wastes and the ecological requirements of various govermental bodies have markedly increased the cost of papermaking. Finally, the cost of the energy required to make paper has increased materially. As a result, the industry and its customers are faced with two choices: either pay the higher costs or materially decrease the amounts and/or quality of the cellulosic fibers with a consequential loss of quality in the finished paper product.

The industry has made various attemps to reduce the cost of the paper products. One approach that has been employed involves the addition of clay and other mineral fillers in the papermaking process to replace fiber but such additions have been found to reduce the strength and other characteristics of the resulting paper to a degree which is unsatisfactory. Also, the addition of such material filler results in poor retention of the filler material, e.g. they pass through the wire to the extent that the level of filler materials builds up in the white water with the result that the clean up of white water and the disposal of the material becomes a serious problem. Various binders have been employed in an attempt to alleviate the retention problem but their use has not been entirely satisfactory.

Attempts have also been made to use types of pulp which are less expensive and of lower quality, but this, of course, results in a reduction in the characteristics of the paper and often results in excessive fines which are not retained in the papermaking process with the consequent white water disposal problems.

Accordingly, the principal object of the invention is the provision of a binder system and method which produce improved properties in paper and which will permit the use of minimum amounts of fiber to attain strengths and other properties which are required. Another object of the invention is the provision of a binder system and a method of employing it which materially increases the strength and other characteristics of paper as compared to a similar paper made with known binders. An additional object of the invention is the provision of a binder system and a method of employing it which materially increases the strength and other characteristics of the paper as compared to a similar paper with known binders. An additional object of the invention is the provision of a binder and a method of employing it which maximizes retention of mineral filler and other materials in the paper sheet when used in the stock on the papermaking machine. A further object of the invention is the provision of a paper having high mineral concentration which has acceptable strength and other characteristics. A final object is the provision for a method of removing suspended solids from white water in a papermaking process.

Other objects and advantages of the invention will become known by reference to the following description and the appended drawings in which.

Figure 1:
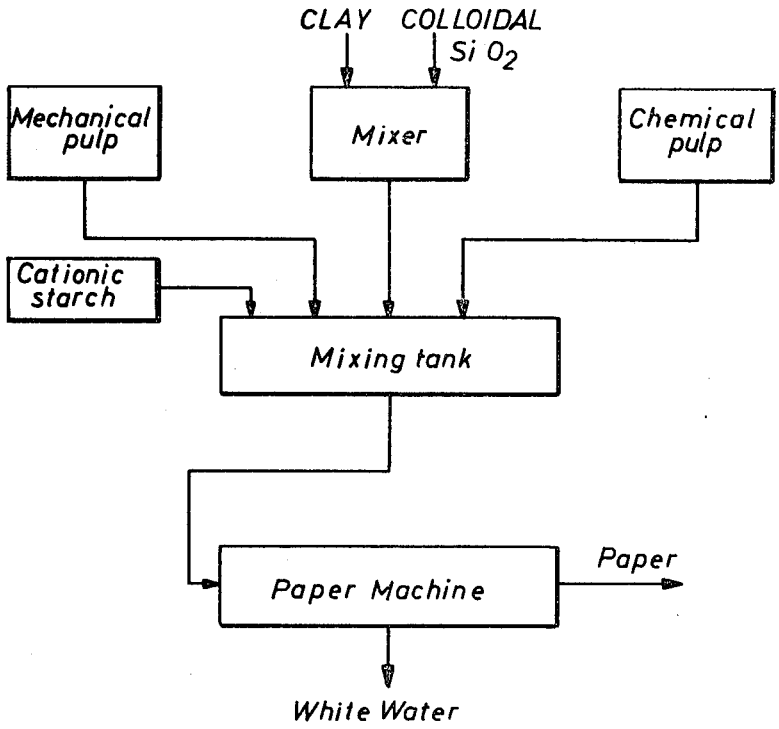
FIG. 1 is a flow diagram of a papermaking process embodying various of the features of the invention.

We have discovered a binder and method of employing it which materially increases the strength and other characteristics of a paper product and which permits the use of substantial amounts of mineral fillers in a papermaking process while maximizing the retention of the filler and cellulosic fines in the sheet. This makes possible, for a given grade of paper, a reduction in the cellulosic fiber content of the sheet and/or the quality of the cellulosic fiber exployed without undue reduction in the strength and other characteristics of the sheet. Also, by employing the principles of the invention the amount of mineral filler material may be increased without unduly reducing the strength and other characteristics of the resulting paper product. Thus, by a reduction in the amount of pulp employed to make a given sheet or the substitution of mineral filler for pulp, the reduction in fiber content permits a reduction in the energy required for pulping as well as a reduction in the energy required for drying the sheet. In addition, it has been found that the retention of the mineral filler and fines is at a sufficiently high level that white water problems are minimized.

We have also discovered that the principles of this invention may be employed to remove suspended fibers and mineral materials in a white water system papermaking process.

In general, the system of the invention includes the use of a binder complex which involves two components, i.e. colloidal silicic acid and cationic starch. The weight ratio between the cationic starch and the $SiO_2$ in the colloidal silicic acid is greater than one and less than about 25. The two components are provided in the stock prior to formation of the paper product on the papermaking machine. It has been found that, after drying, the sheet has greatly enhanced strength characteristics. Also, it has been found that when mineral fillers such as clay, chalk and the like are employed in the stock, these mineral fillers are efficiently retained in the sheet and further do not have the degree of deleterious effect upon the strength of the sheet that will be observed when the binder system is not employed.

While the mechanism that occurs in the stock and during paper formation and drying in the presence of the binder is not entirely understood, it is believed that the cationic starch and the anionic colloidal silicic acid form a complex agglomerate which is bound together by the anionic colloidal silicic acid, and that the cationic starch becomes associated with the surface of the mineral filler material whose surface is either totally or partially anionic. The cationic starch also becomes associated with the cellulosic fiber and the fines, both of which are anionic. Upon drying, the association between the agglomerate and the cellulosic fibers provides extensive hydrogen bonding. This theory is supported in part by the fact that as the Zeta potential in the anionic stock moves towards zero when employing the binder complex of the invention both the strength characteristics and the retention improve.

Based upon the work that has been done to date, the principles of this invention are believed applicable in the manufacture of all grades and types of paper products. For example, printing grades, incl. newsprint, tissue, paperboard and the like.

It has been found that the greatest improvements are observed when the binder is employed with chemical pulps, e.g. sulfate and sulfite pulps from both hard and soft wood. Lesser but highly significant improvements occur with thermo-mechanical and mechanical pulps. It has been noted that the presence of excessive amounts of lignin in ground wood pulps seems to interfere with the efficiency of the binder so that such pulps may require either a greater proportion of binder or the inclusion of a greater proportion of other pulp of low lignin content to achieve the desired result. (As used herein, the terms "cellulosic pulp" and "cellulosic fiber" refer to chemical, thermo-mechanical and mechanical or ground wood pulp and the fibers contained therein).

The presence of cellulosic fibers is essential to obtain certain of the improved results of the invention which occur because of the association of the agglomerate and the cellulosic fibers. Preferably, the finished paper should contain over 50% cellulosic fiber, but paper containing lesser amounts of cellulosic fibers may be produced which have greatly improved properties as compared to paper made from similar stocks not employing the binder agglomerate described herein.

Mineral filler material which can be employed includes any of the common mineral fillers which have a surface which is at least partially anionic in character. Mineral fillers such as kaolin (china clay), bentonite, titanium dioxide, chalk and talc all may be employed satisfactorily. (The term "mineral fillers" as used herein includes, in addition to the foregoing materials, wollastonite and glass fibers). When the binder complex disclosed herein is employed, the mineral fillers will be substantially retained in the finished product and the paper produced will not have its strength degraded to the degree observed when the binder is not employed.

The mineral filler is normally added in the form of an aqueous slurry in the usual concentrations employed for such fillers.

As pointed out above, the binder comprises a combination of colloidal silicic acid and cationic starch. The colloidal silicic acid may take various forms, for example, it may be in the form of polysilicic acid or colloidal silica sols, although best results are obtained through the use of colloidal silica sols.

Polysilicic acid can be made by reacting water glass with sulfuric acid by known procedures to provide molecular weights (as $SiO_2$) up to about 100,000. However, the resulting polysilicic acid is unstable and difficult to use and presents a problem in that the presence of sodium sulphate causes corrosion and other problems in papermaking and white water disposal. The sodium sulphate may be removed by ion exchange through the use of known methods but the resulting polysilicic acid is unstable and without stabilisation will deteriorate on storage. Salt-free polysilicic acid may also be produced by direct ion exchange of diluted water glass.

While substantial improvements are observed in both strength and retention with a binder containing polysilicic acid and cationic starch, supêrior results are obtained through the use with the cationic starch of colloidal silica in the form of a sol containing between about 2–60% by weight of $SiO_2$ and preferably about 4–30% $SiO_2$ by weight.

The colloidal silica in the sol should desirably have a surface area of from about 50 to 1000 $m^2/g$ and preferably a surface area from about 200 to 1000 $m^2/g$ with best results being observed when the surface area is between about 300 to 700 $m^2/g$. The silica sol is stabilized with an alkali having a molar ratio of $SiO_2$ to $M_2O$ of from 10:1 to 300:1 and preferably a ratio of from 15:1 to 100:1 (M is an ion selected from the group consisting of Na, K, Li and $NH_4$). It has been determined that the size of the colloidal silica particles should be under 20 nm and preferably should have an average size ranging from about 10 down to 1 nm (A colloidal silica particle having a surface area of about 500 $m^2/A$ involves an average particle size of about 5.5 nm).

In essence, it is preferably sought to employ a silica sol having colloidal silica particles which have a maximum active surface and a well defined small size generally averaging 4–9 nm.

Silica sols meeting the above specifications are commercially available from various sources including Nalco Chemical Company, Du Pont & de Nemours Corporation and the Assignee of this invention.

The cationic starch which is employed in the binder may be made from starches derived from any of the common starch producing materials, e.g. corn starch, wheat starch, potato starch, rice starch, etc. As is well known, a starch is made cationic by ammonium group substitution by known procedures. Best results have been obtained when the degree of substitution (d.s.) is between about 0.01 and 0.05 and preferably between about 0.02 and 0.04. While a wide variety of ammonium compounds, preferably quaternary, are employed in making cationized starches for use in our binder, we prefer to employ a cationized starch which was prepared by treating the base starch with 3-chloro-2-hydroxypropyl-trimethyl ammonium chloride to obtain a cationized starch having 0.02–0.04 d.s.

In the papermaking process the binder is added to the papermaking stock prior to the time that the paper product is formed on the papermaking machine. The two ingredients, the colloidal silicic acid component and the cationic starch, may be mixed together to form an aqueous slurry of the silica-cationic starch binder complex which then can be added to and thoroughly mixed with the papermaking stock. However, this procedure does not provide maximized results. It is preferable that the silica-cationic starch complex is formed in situ in the papermaking stock. This can be accomplished by adding the colloidal silicic acid component in the form of an aqueous sol and the cationic starch in the form of an aqueous solution separately to the stock in a mixing tank or at a point in the system where there is adequate agitation so that the two components are dispersed with the papermaking components so that they interact with each other, and with the papermaking components at the same time.

Even better results are obtained if the colloidal silicic acid component is added to a portion of the stock and thoroughly mixed therewith after which the make-up of the stock is completed and the cationic starch component is added and thoroughly mixed with the stock prior to the formation of the paper product.

In the event that a mineral filler is to be added to the stock it has been found preferable to slurry the mineral filler in water with the colloidal silicic acid component and then to introduce the filler-colloidal silicic acid component slurry into a mixing device where it is incorporated into the stock along with the pulp and cationic starch.

It has been found that in a papermaking process employing the binder complex described herein, the pH of the stock is not unduly critical and may range from a pH of from 4 to 9. However, pH ranges higher than 9 and lower than 4 are undesirable. Also, other paper chemicals such as sizing agents, alum and the like may be employed but care should be taken that the level of these agents is not great enough to interfere with the formation of the silica-cationic starch agglomerate and that the level of the agent in recirculating white water does not become excessive so as to interfere with the formation of the binder agglomerate. Therefore, it is usually preferred to add the agent at a point in the system after the agglomerate is formed.

According to the invention, the ratio of cationic starch to the colloidal silicic acid component should be between 1:1 and 25:1 by weight. Preferably, the ratio is between 1.5:1 and 10:1.

The amount of binder to be employed varies with the effect desired and the characteristics of the particular components which are selected in making up the binder. For example, if the binder includes polysilicic acid as the colloidal silicic acid component, more binder will be required than if the colloidal silicic acid component is colloidal silica having a surface area of 300 to 700 $m^2/g$. Similarly, if the cationic starch, for example, has a d.s. of 0.025 as compared to a d.s. of 0.030, more binder will be required, assuming the colloidal silicic acid component is unchanged.

In general, when the stock does not contain a mineral filler the level of binder may range from 0.1 to 15% by weight and preferably from 1 to 15% by weight based upon the weight of the cellulosic fiber. As pointed out above, the effectiveness of the binder is greater with chemical pulps so that less binder will be required with these pulps to obtain a given effect than other types. In the event that a mineral filler is employed the amount of binder may be based on the weight of the filler material and may range from 0.5 to 25% by weight and usually between 2.5 to 15% by weight of the filler.

As has been pointed out, the binder may be added to the white water of a papermaking machine in a system in which the binder system is not being used. The binder effectively forms an agglomerate with the papermaking fines and the suspended mineral material which makes possible the efficient settling of concentration of the suspended solids to provide a relatively clear fraction of water which can be returned to the papermaking system, and a fraction in which the suspended solids are concentrated and from which they can be removed by filtration or other means. The amount of the binder system or complex required, with the cationic starch to $SiO_2$ ratios as set forth above, can be relatively small and in most instances is less than about 10% by weight based upon the dry weight of solids in the white water and the dry weight of the binder system. A useful broad range of the amount of the binder system or complex is from about 1 to about 20% by weight, preferably from about 2 to about 10% by weight.

The following specific examples show the effects of the binder employed in a papermaking process upon the retention of mineral filler and upon the strength characteristics of the paper produced and upon white water.

EXAMPLE I

A trial was run making a base stock for wallpaper, the paper stock having a high clay content. The run was made on a Fourdrinier machine having an estimated capacity of about 6000 kg/h. The machine speed was approximately 250 m/min. and the target grammage was 90 $g/m^2$. FIG. 1 is a flow diagram indicating the sequence of operations.

The fiber in the stock comprised a mixture of a mechanical pulp and a chemical pulp. The mechanical pulp was unbleached and was refined to a Canadian Standard Freeness (CSF) of 100. The chemical pulp employed was a bleached sulfate hardwood pulp which was refined to 400 CSF. During the refining process, suitable amounts of water were, of course, added to the pulp to provide the desired consistency.

Papermakers' china clay and a colloidal silica sol were dispersed in water to provide a slurry containing 5 percent clay by weight. The china clay had a particle size distribution in the range of form about 0.5 to 10 μm. The colloidal silica was in the form of a 15% sol which was stabilized with alkali with a molar ratio of $SiO_2$:-$Na_2O$ of 45:1. The silica had a particle size in the range of from about 5–7 nm and a surface area of approximately 500 $m^2/g$. The colloidal silica was added to provide 2.86% $SiO_2$ based upon the weight of the clay. The pH of the clay-$SiO_2$ slurry was about 8.

Figure 2:
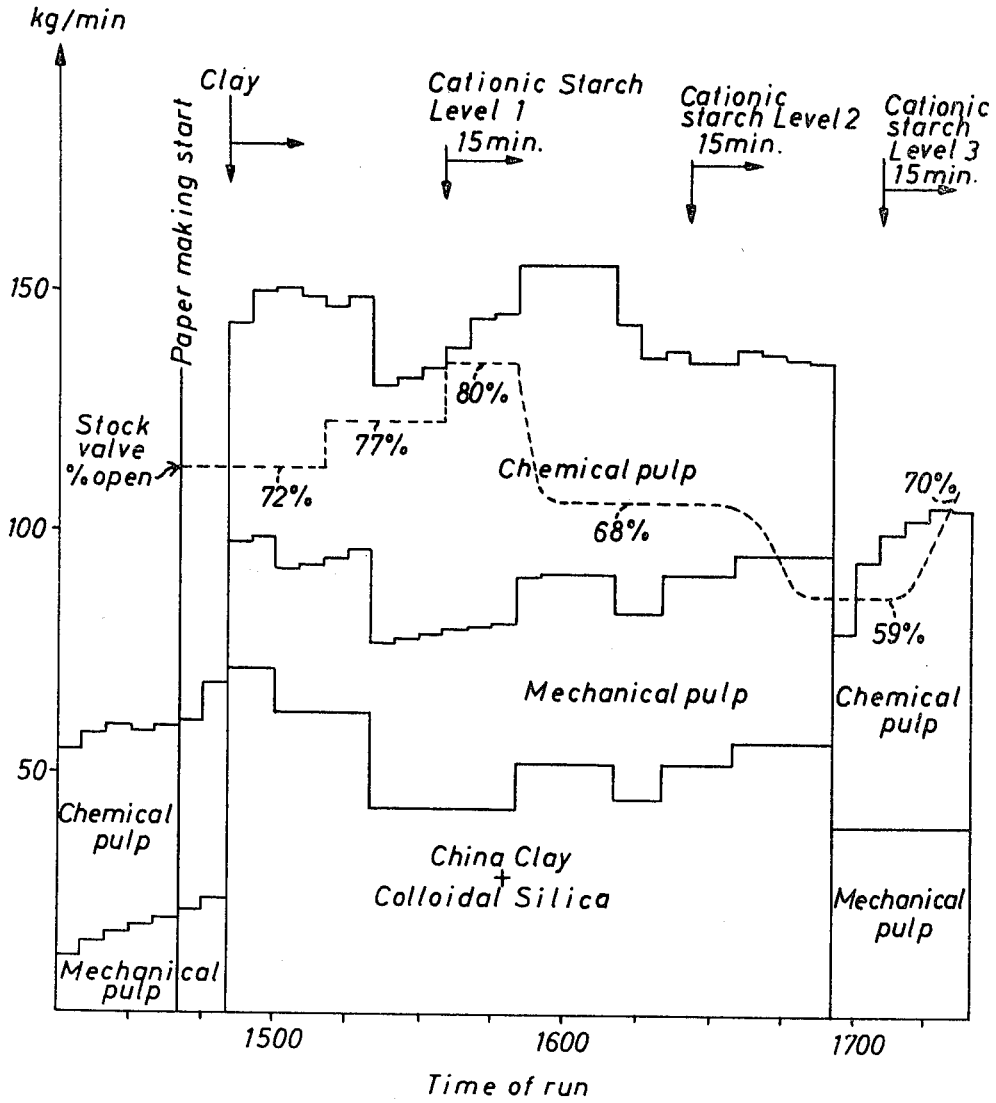
FIG. 2 and FIGS. 2A through 2S are charts showing a test run on a papermaking machine in Example I and the properties of the paper resulting therefrom, the process employed embodying various of the features of the invention.
Figure 2A:
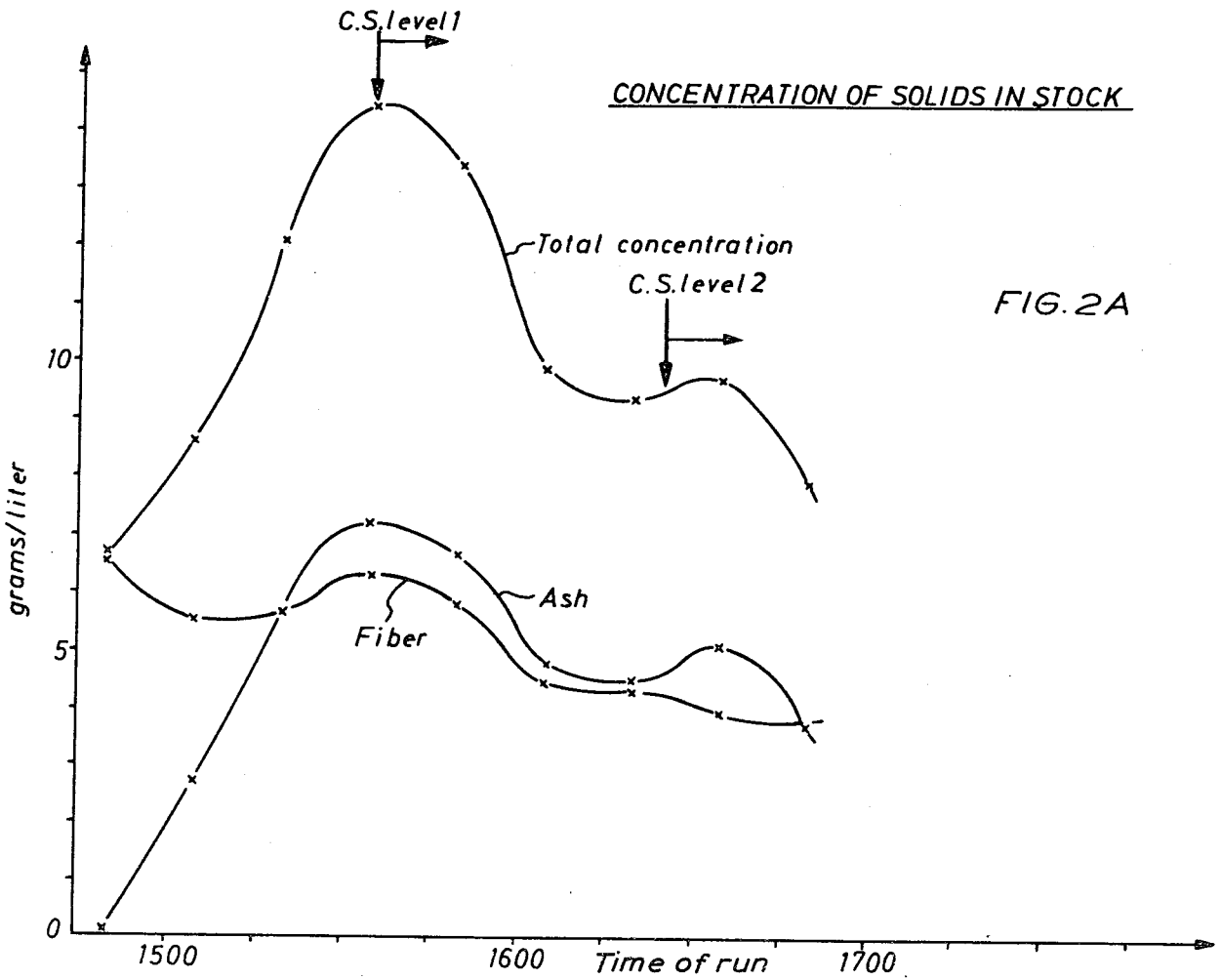

FIG. 2 shows the level of feed to the papermaking machine during the test run, in kg/min. at the various times during the run. The consistency of the stock flowing to the paper machine ranged from about 6 to about 15 g/l, as shown in FIG. 2A, the time in FIG. 2A being correlated to the times shown on FIG. 2.

As illustrated in FIG. 2, the run was begun at 1410 hours by mixing the chemical pulp and mechanical pulp in the proportions shown. At 1440 hours the stock valve was opened and stock flowed to the papermaking machine. The dotted line in FIG. 2 shows the adjustment of the stock valve during the process.

Initially, the stock feed to the machine was constituted entirely of a mixture of chemical and mechanical pulp. However, at 1450 hours the china clay-colloidal silica mixture was introduced into the mixing tank and the papermaking machine was run with the fiber-clay stock until the ash content of the stock and the white water came to equilibrium. At approximately 1535 hours, a slurry of cationic starch was added to and thoroughly mixed with the pulp, clay and colloidal silica in the mixing tank to provide the stock containing the complete binder. The level of cationic starch added at 1535 hours was 7.14 percent by weight of starch based upon the weight of clay, the ratio of cationic starch to colloidal silica being 2.49. (This level of starch in this example and in the drawings is sometimes referred to as "LEVEL 1"). At 1625 hours, the level of cationic starch was raised to 8.57 percent based upon the weight of clay, the ratio of cationic starch to colloidal silica then being raised to 2.99 (This level of starch in this example and in the drawings is sometimes referred to as "LEVEL 2"). At 1702 hours, the level of cationic starch was raised to 11.43 percent based upon the weight of clay, the ratio of cationic starch to colloidal silica then being 3.99 (This level of starch in this example and in the drawings is sometimes referred to as "LEVEL 3"). At all times during the run, the pH of the stock on the machine was approximately 8.

The cationic starch was prepared by treating potatoe starch with 3-chloro-2-hydroxypropyl-trimethylammonium chloride to provide a degree of substitution (d.s.) in the starch of 0.03. It was dispersed in cold water at a concentration of about 4% by weight, heated for 30 min. at about 90° C., diluted with cold water to a concentration of about 2% by weight and then added to the mixing tank as indicated in FIG. 1.

For reference purposes, it was determined that after an addition or change was made in the mixing tank (the time of addition being indicated by the vertical arrows in FIG. 2), it required approximately 15 minutes for the change to stabilize on the papermaking machine (Indicated by the horizontal arrows in FIG. 2).

After the addition of the cationic starch to Level 1, i.e. to a ratio of 2.49 of the silica, the grammage of the paper rose rapidly as the mineral content in the paper was increased because of the retention of the mineral content with the papermaking fibers on the wire of the machine. The stock valve was then adjusted to reduce the grammage to the 90 g/m$^2$ level and, by adjustment of the stock valve, the grammage was maintained relatively constant as the ash content rose slowly. During this period of time, the solids in the white water were reduced by approximately 50 percent as more and more of the solid materials were retained.

When the level of cationic starch was increased to Level 2, i.e. a ratio of 2.99 to the silica, the grammage and ash contents of the paper again increased and the solids in the white water were further reduced as the level of retention again increased.

After the addition of the cationic starch to the system and the increased retention of clay was observed it was found that the driers overdried the paper. The steam consumption in the drier was lowered and several of the drying cylinders were shut off because of more rapid drying. In spite of the reduction in heat to the driers, the paper was periodically overdried. The decrease in steam consumption resulted from the fact that the fiber content of the paper was markedly reduced as the retention increased, thus facilitating drying.

Even though the mineral content (measured as ash content) of the paper was greatly increased, the papermaking machine was run at the same speed and without changes in dewatering conditions throughout the trial.

Figure 2B:
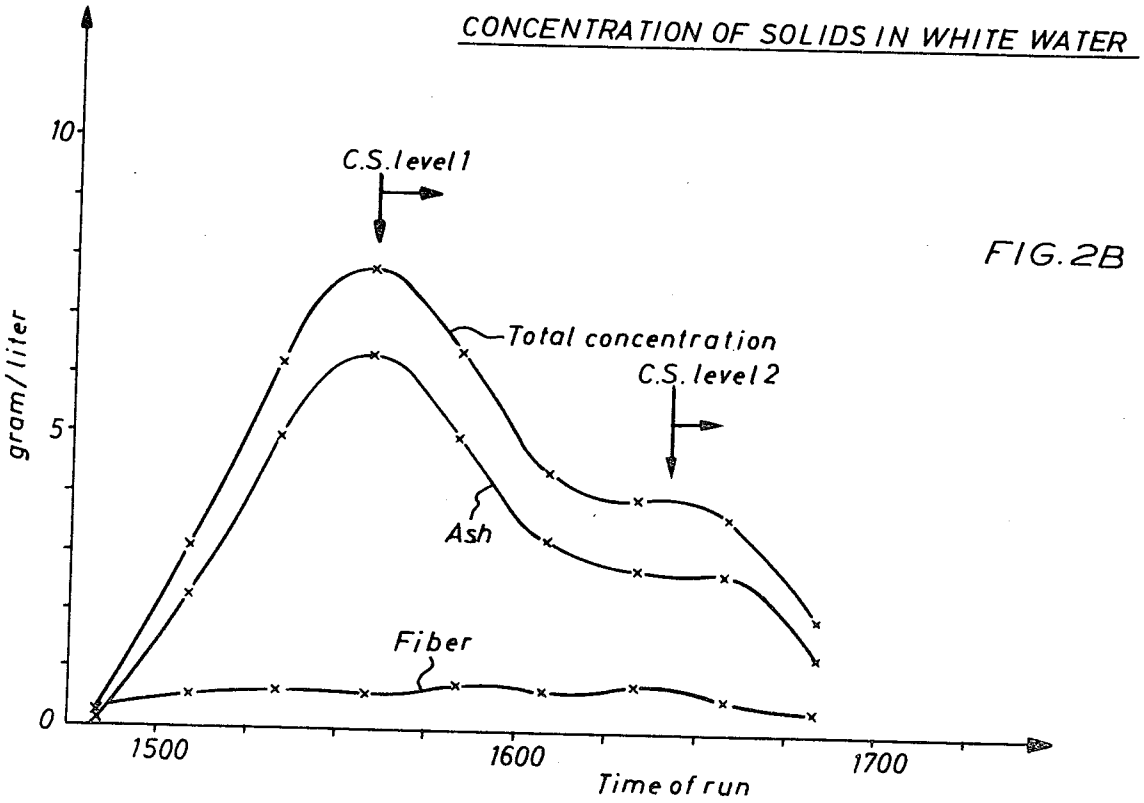
Figure 2C:
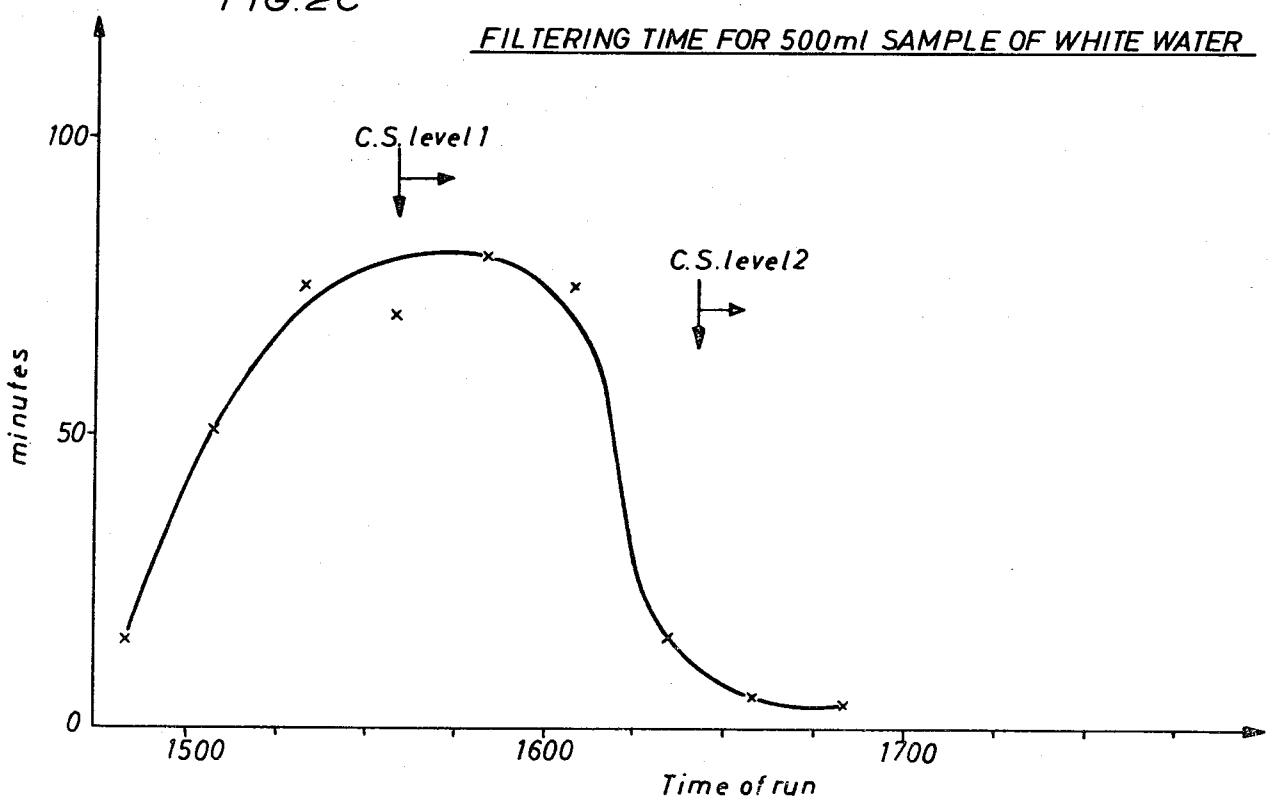
Figure 2D:
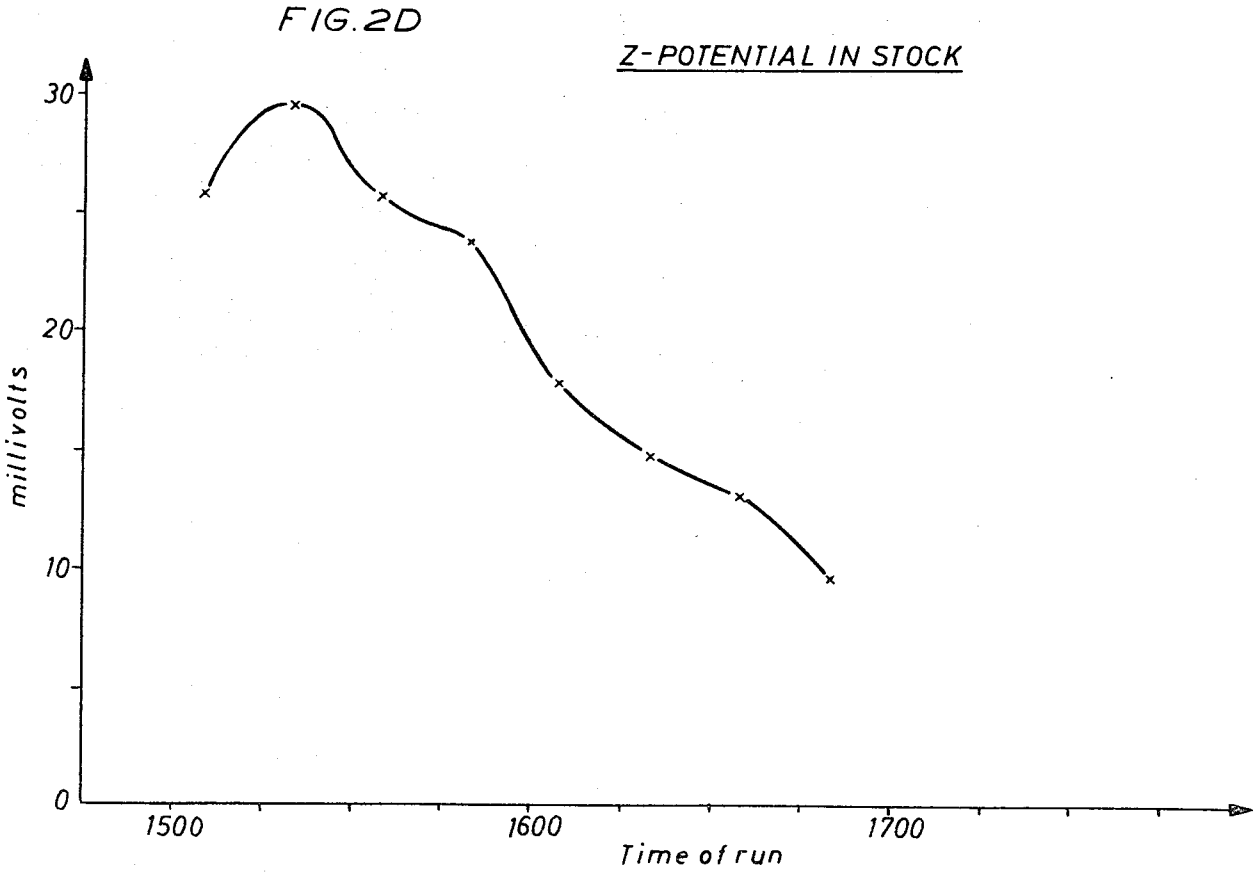
Figure 2E:
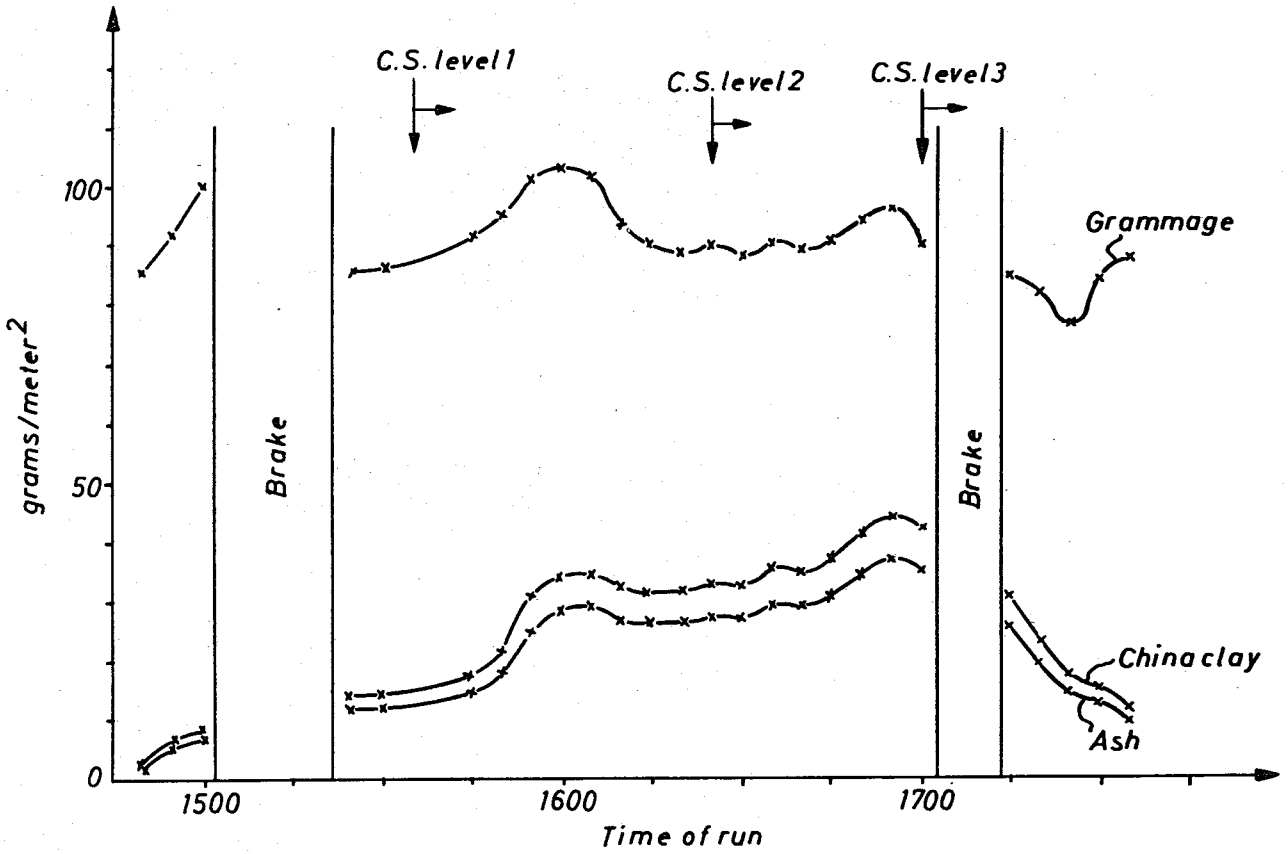
Figure 2F:
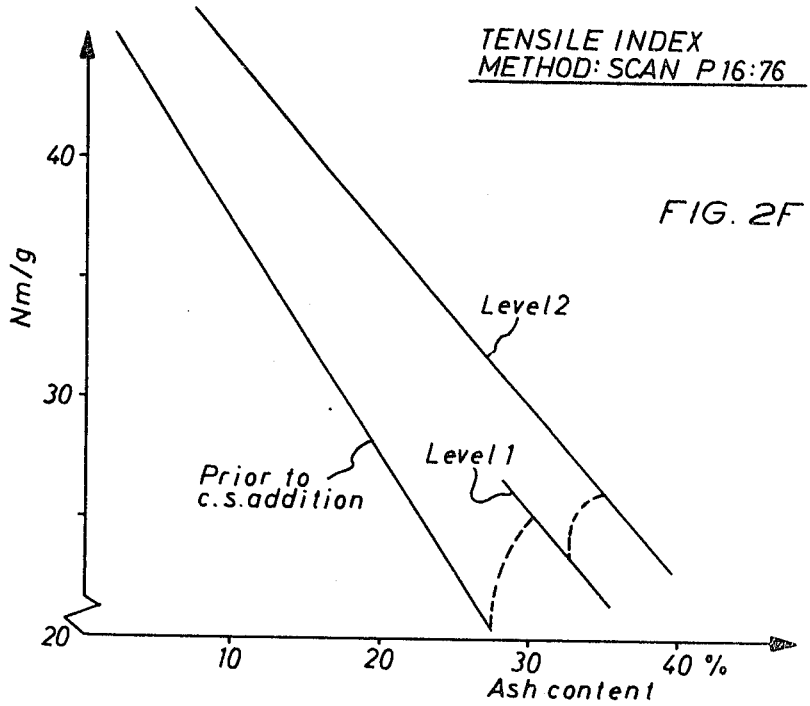
Figure 2G:
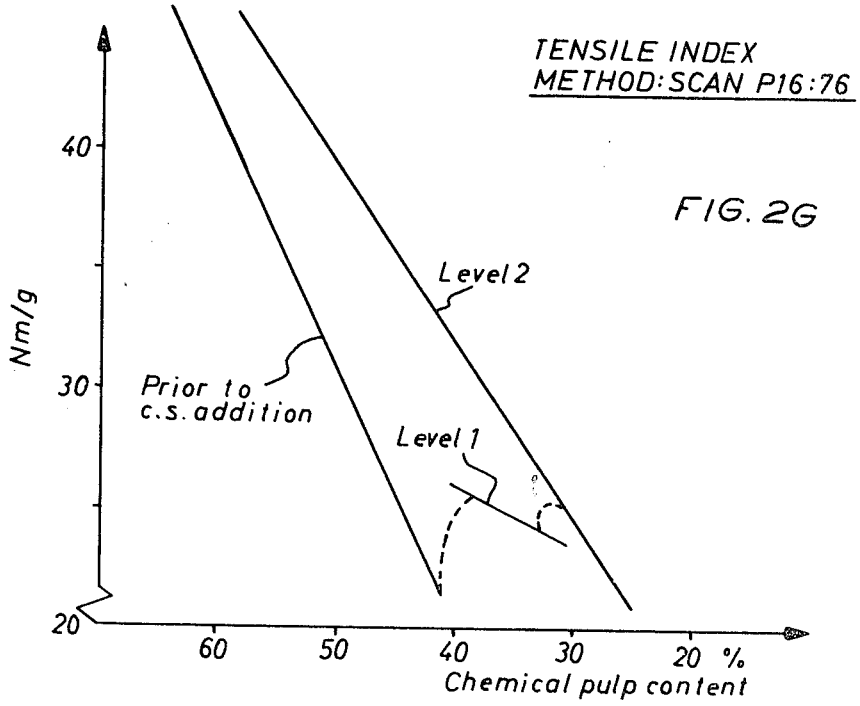
Figure 2H:
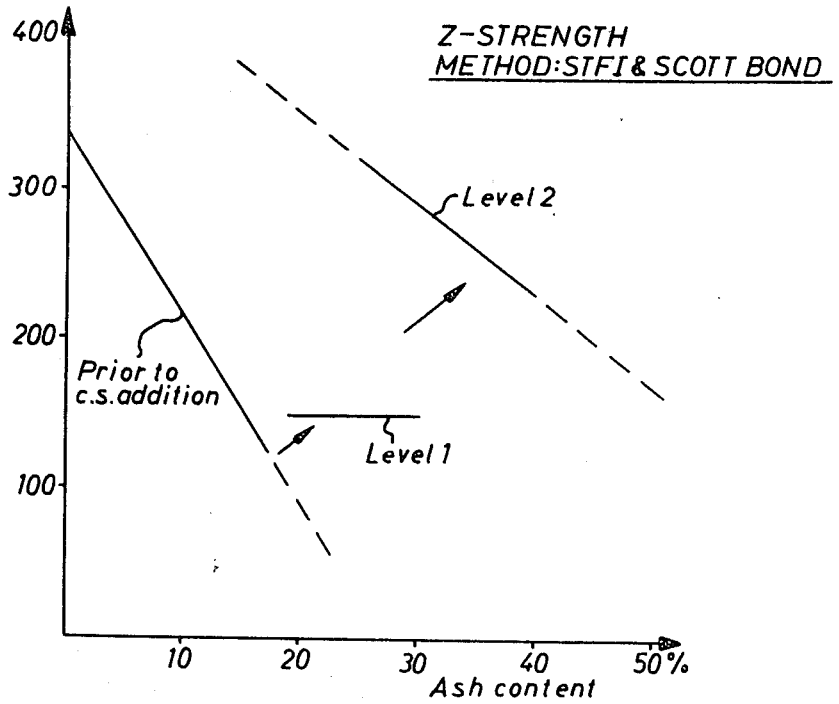
Figure 2I:
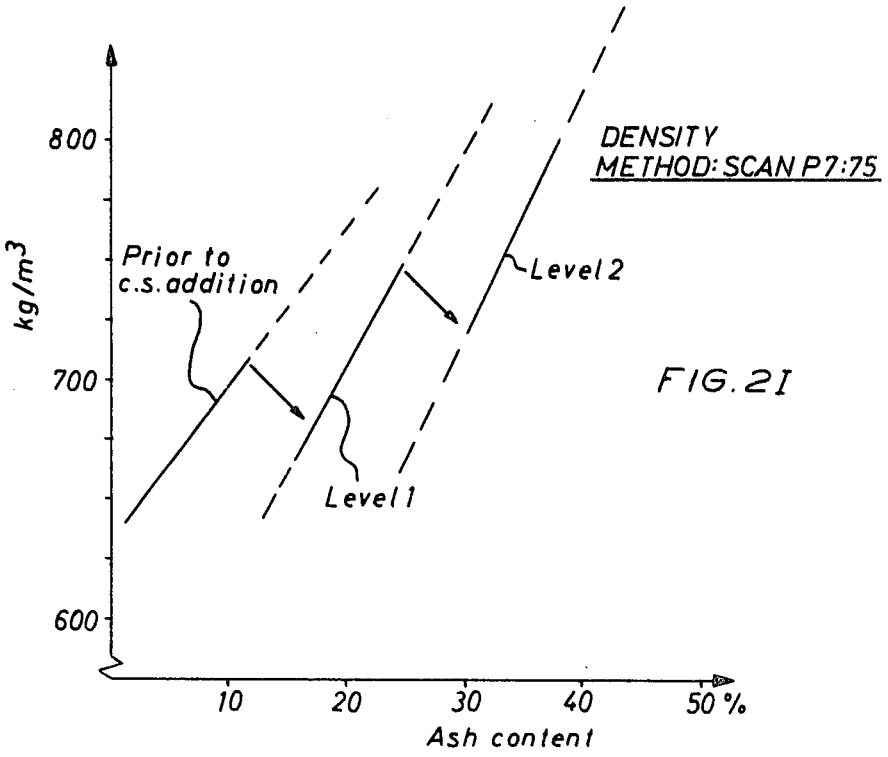
Figure 2J:
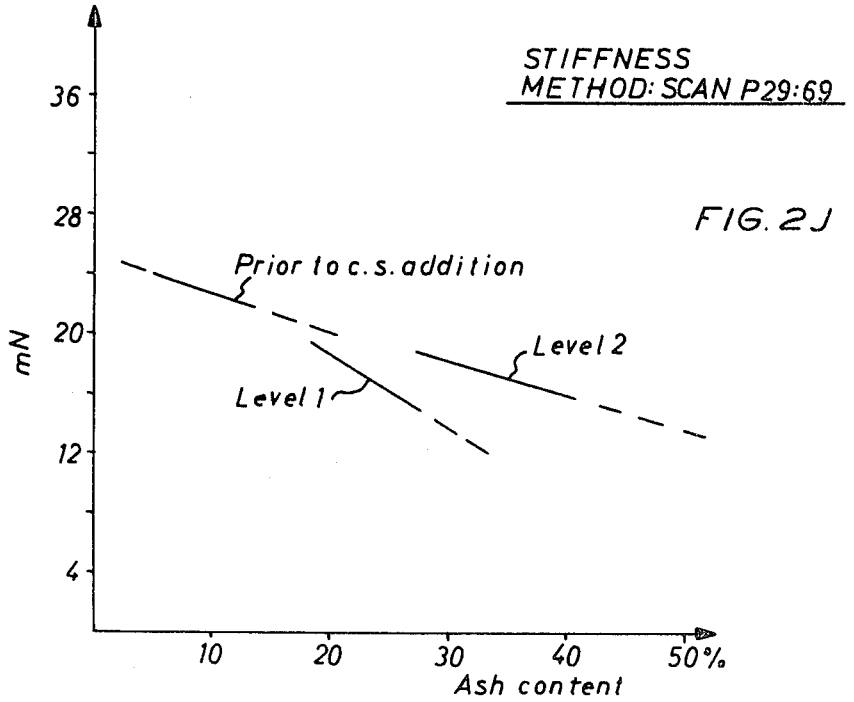
Figure 2K:
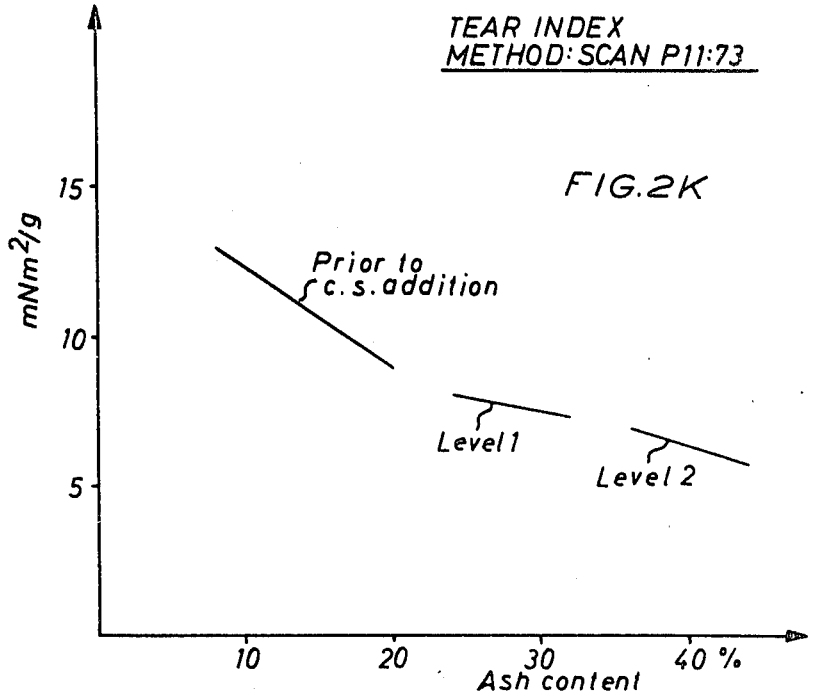
Figure 2L:
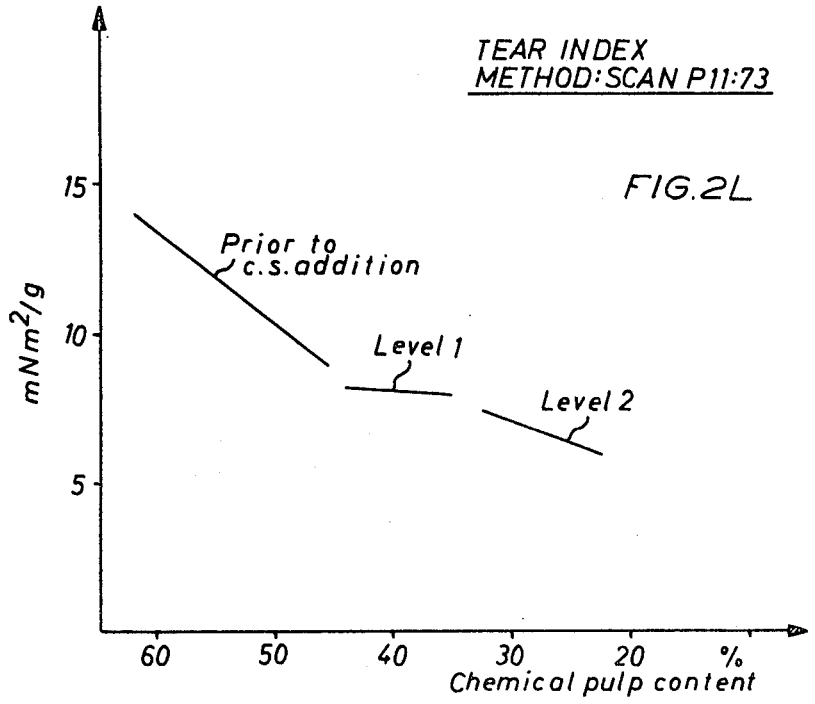
Figure 2M:
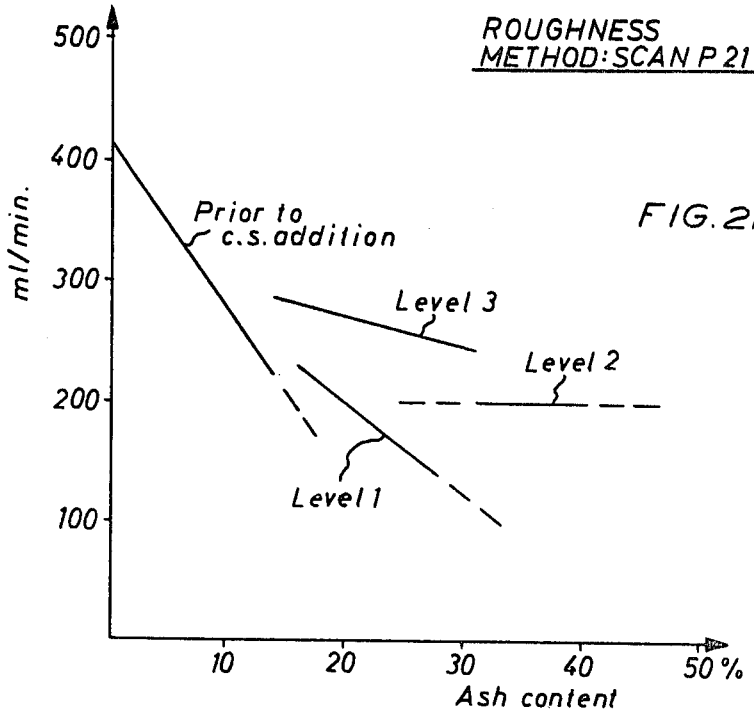
Figure 2N:
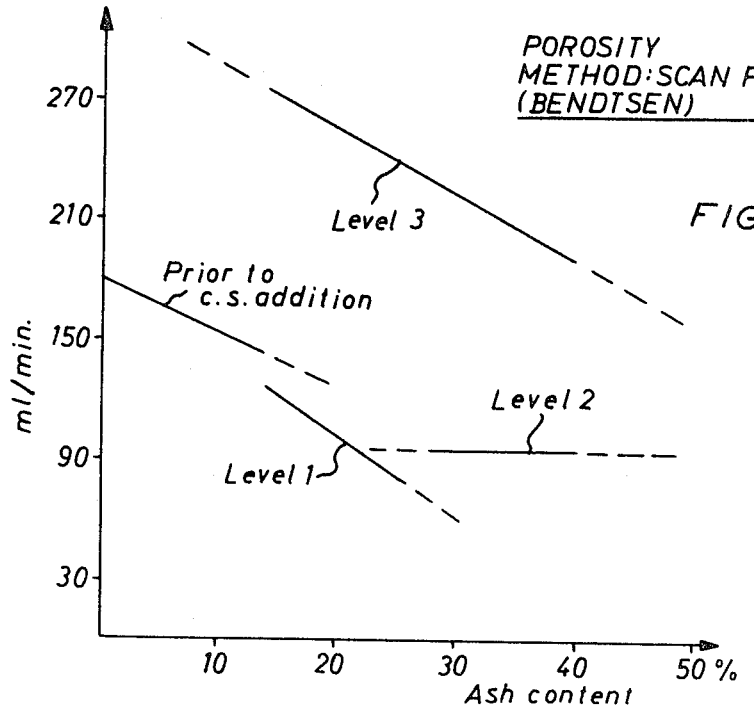
Figure 20:
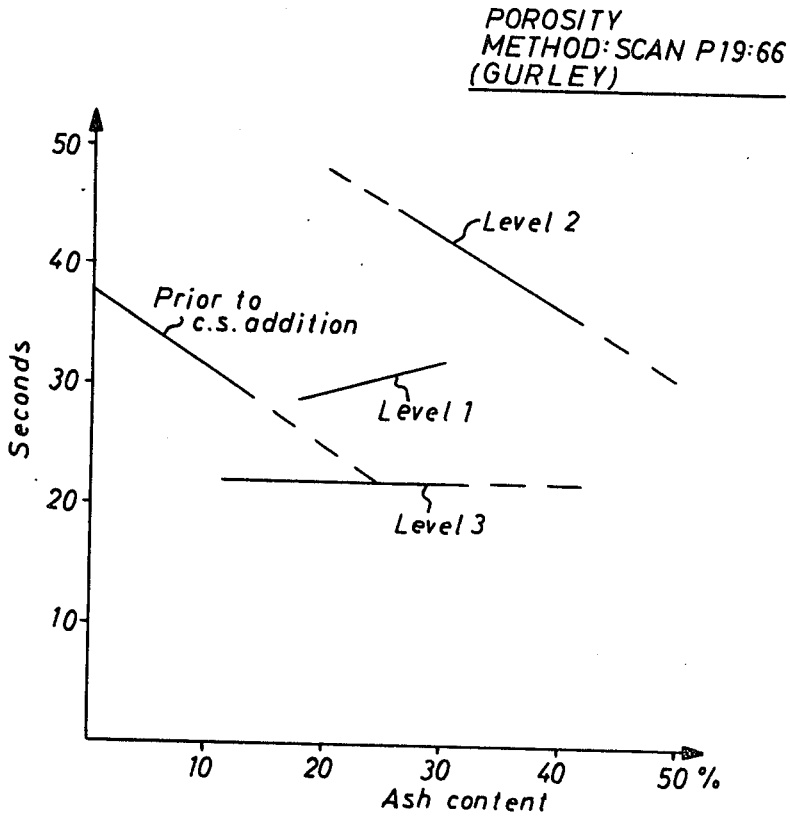
Figure 2P:
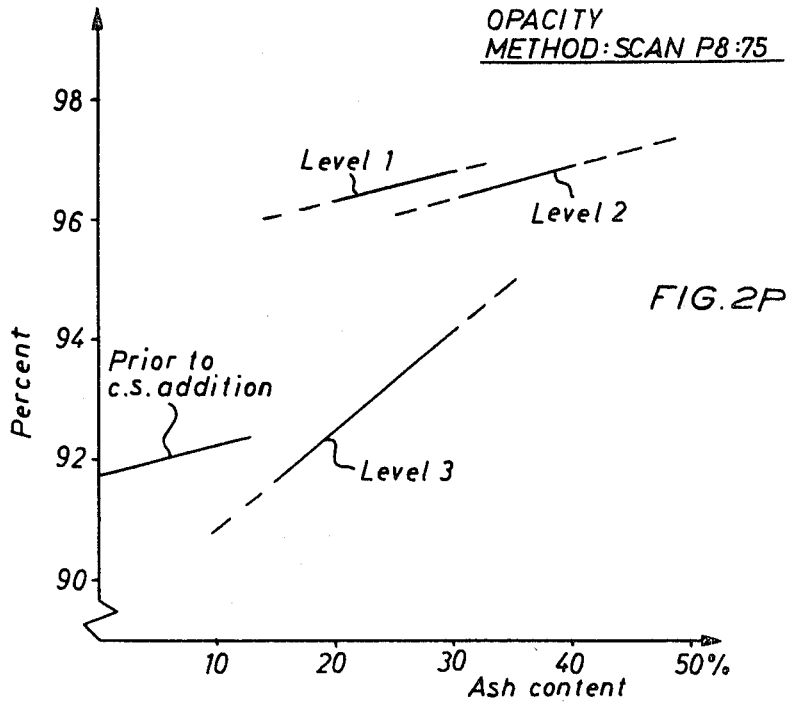
Figure 2Q:
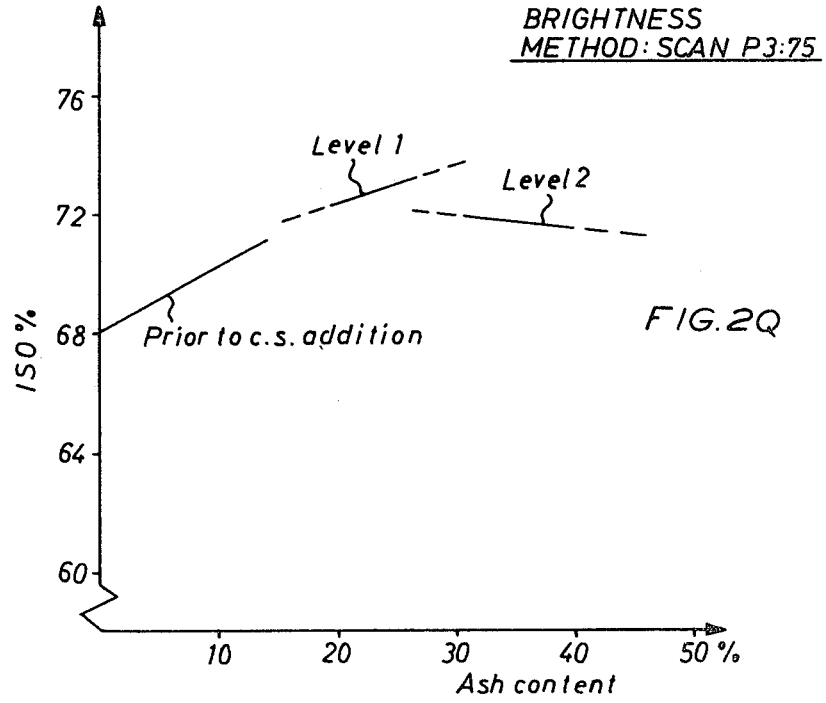
Figure 2R:
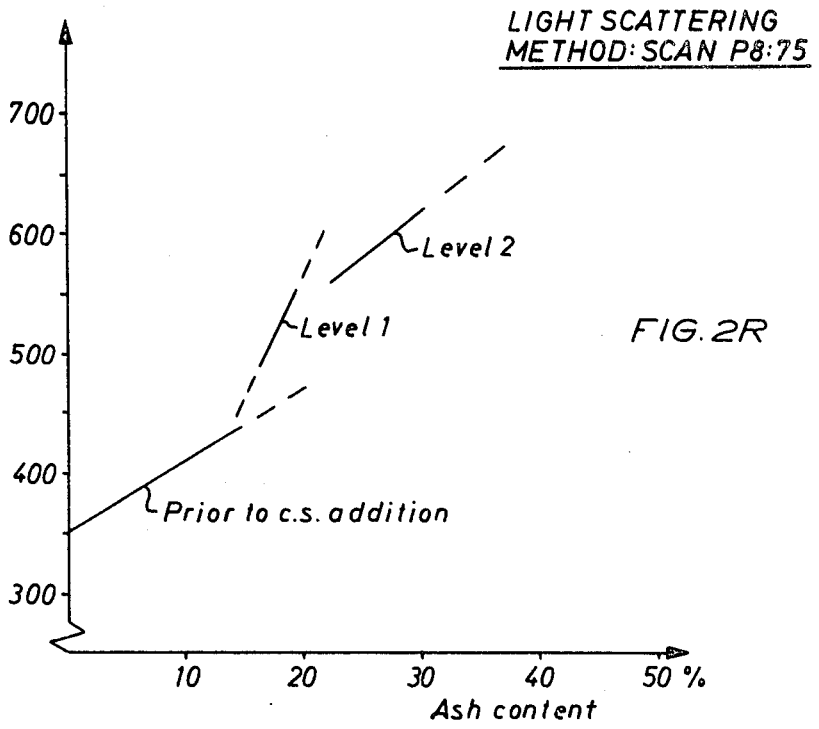
Figure 2S:
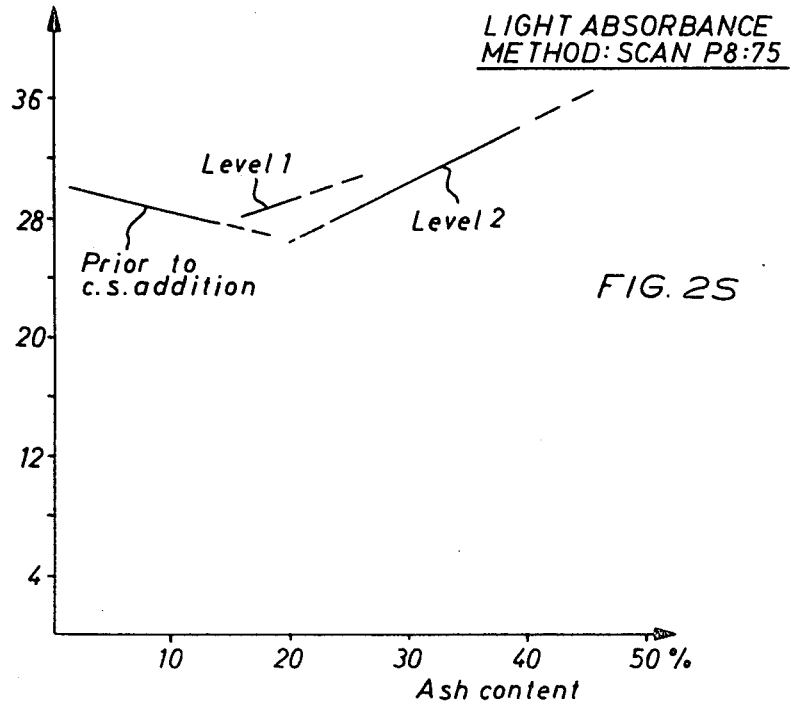

The conditions and results of the run are graphically illustrated in FIGS. 2A–2S.

In FIG. 2A the concentration of solids in the stock is shown correlated to the time of the run. It will be noted that the total concentration of solids slightly exceeds the total of fiber and ash. This is because the ash determination drives out the water of hydration and other water associated with the clay.

FIG. 2B shows the level of solids in the white water. Again, the total concentration of solids exceeds the sum of fiber and ash for the reason given above. In connection with FIG. 2B it should be noted that the level of ash (in this case non-retained minerals) rises rapidly until the cationic starch at Level 1, has been added and has had a chance to reach equilibrium in the system. When the level of cationic starch is increased to Level 2 another dramatic decrease occurs.

The combination of the colloidal silica and the cationic starch as a binder also increases the filtering speed of the white water through the wire as shown in FIG. 2C. The drainage time per unit volume increased until the combination binder was present at Level 1 and thereafter rapidly decreased. With the addition of the cationic starch at Level 2 the decrease in time per unit volume was even greater.

FIG. 2D shows the Zeta potential in the stock which is adjusted towards 0 by the addition of the cationic starch component. As will be noted, the adjustment corresponds to increased retention and improved characteristics.

FIG. 2E graphically illustrates the grammage of the paper during the run. There were two occasions when the web broke on the machine as indicated.

FIG. 2F is a chart showing the tensile index of the paper produced in this example. It should be noted that, because of the moisture driven from the ash, the amount of china clay in the paper is approximately 120 percent of the amount of ash shown. As will be observed, the tensile index is greatly improved and the clay acts in the presence of the colloidal silica-cationic starch complex binder to increase the tensile index.

FIG. 2G is a chart similar to FIG. 2F, except that the tensile index is correlated to the level of chemical pulp.

FIG. 2H shows the improved Z strengths in the resulting paper despite the fact that the paper contains substantial amounts of clay.

FIGS. 2I through 2S are charts showing the properties of the paper made by the process of this example which demonstrate the effectiveness of the complex silica-cationic starch bond. It should be noted that in the case of FIG. 2M having to do with the roughness of the sheet, the paper was somewhat overdried at times so the conclusions as to this property which can be drawn from the chart may not be entirely valid.

As will be apparent from the results of the run and the properties of the papers produced thereby, the employment of the binder complex causes a mutual floculation of the mineral matter, the cellulosic materials and the binder to produce highly improved retention and paper properties. Thus, the binder permits the incorporation of substantial amounts of mineral filler with a cellulosic pulp to obtain the same or better properties than can be obtained in a sheet having a greater proportion of cellulosic fibers and a lesser amount of mineral filler when the binder of the invention is not employed.

EXAMPLE II

Hand sheets were made up in a laboratory hand sheet former from various stocks made from bleached soft wood sulfate pulp with and without wollastonite as a filler, the stock including the cationic starch colloidal silica complex binder to enhance the properties of the resultant paper. The wollastonite used was in the form of acicular crystals between about 1 and 20 μm in diameter and having a length of about 15 times the diameter.

The colloidal silicic acid which was used was a silica sol containing 15 percent of colloidal silica having a surface area of approximately 500 m$^2$/g. The sol was alkali stabilized with a molar ratio of $SiO_2$:$Na_2O$ of 40:1.

The cationic starch (C.S.) employed was the same starch employed in Example I having a degree of substitution of 0.03. The cationic starch was added in the form of a 4 percent (by weight) aqueous solution.

In the procedure, the colloidal silica sol was added to the stock before the cationic starch. In the examples containing wollastonite, the sol and cationic starch were added with the mineral to form a mineral-binder slurry which was then added to the cellulose. The usual amount of water was added to make up a papermaking stock of the desired consistency of about 1% by weight solids. After the hand sheets were made they were pressed and dried under substantially identical conditions.

In the following table the composition of the solids in each stock is set forth and the Z-strength (Scott Bond) was measured to provide an indication of the properties of the resulting sheet after pressing and drying.

| Sample No. | Pulp g | Wollastonite g | 4% C.S. g | 15% Sol g | Z-strength (Scott Bond) |
|---|---|---|---|---|---|
| 1 | 2.1 | 0 | 0 | 0 | 204 |
| 2 | 2.1 | 0.9 | 0 | 0 | 154 |
| 3 | 2.1 | 0 | 1.69 | 0 | 313 |
| 4 | 2.1 | 0.9 | 1.69 | 0 | 209 |
| 5 | 2.1 | 0 | 1.69 | 0.450 | 388 |
| 6 | 2.1 | 0 | 1.69 | 0.225 | 622 |
| 7 | 2.1 | 0 | 1.69 | 0.150 | 586 |
| 8 | 2.1 | 0 | 1.69 | 0.113 | 568 |
| 9 | 2.1 | 0.9 | 1.69 | 0.450 | 266 |
| 10 | 2.1 | 0.9 | 1.69 | 0.225 | 291 |
| 11 | 2.1 | 0.9 | 1.69 | 0.150 | 380 |
| 12 | 2.1 | 0.9 | 1.69 | 0.133 | 410 |

Figure 3:
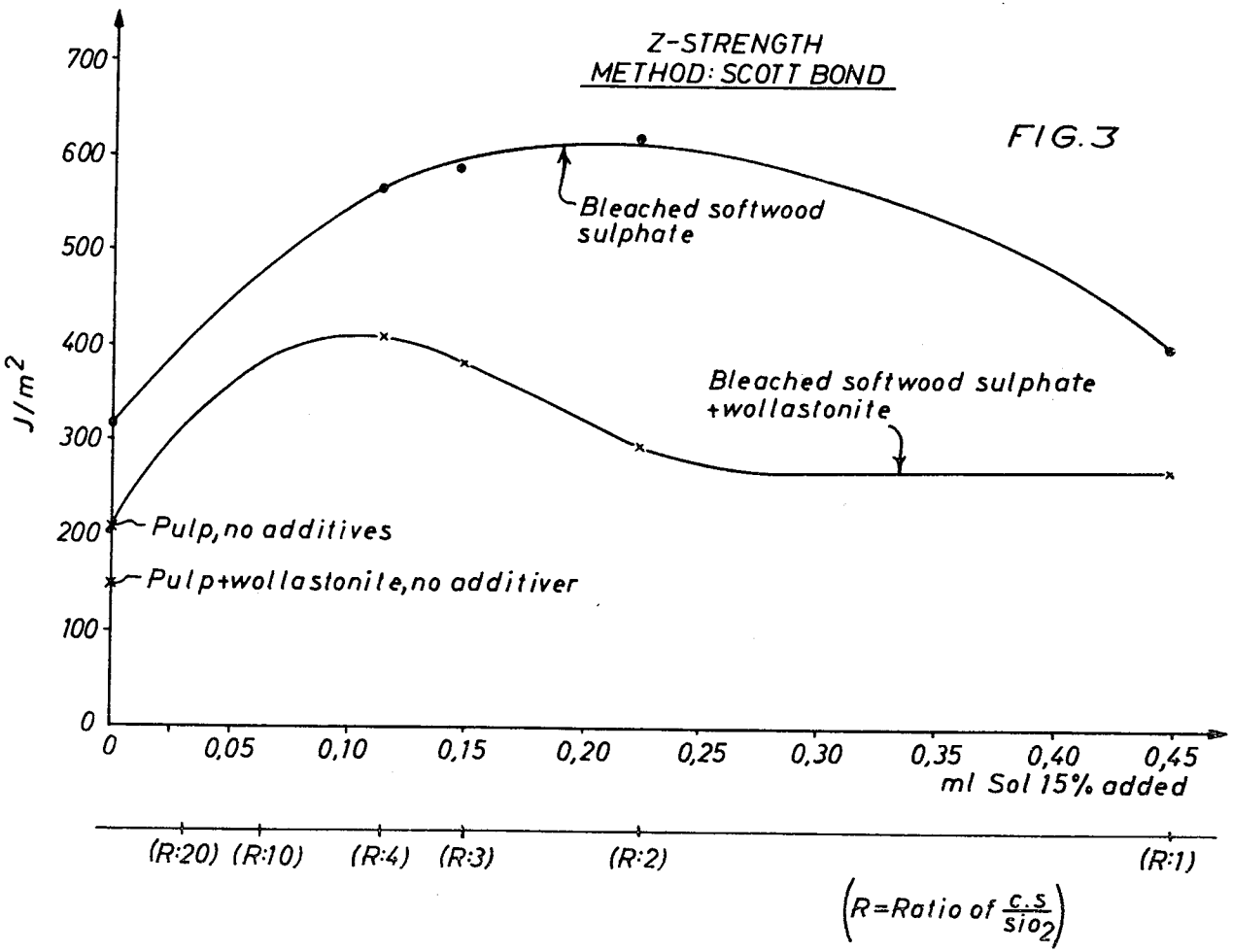
FIG. 3 is a chart graphically portraying the results of Example II.

The results are plotted in FIG. 3 which illustrates the enhanced strength which results from the silica-cationic starch complex binder. As will be seen from the chart, the Z-strength of a sheet made from a stock containing 30% wollastonite in the solids as compared with a sheet containing only the fibrous cellulosic portion when the binder is employed, is higher. Also, the use of the binder with a sheet containing only cellulosic fiber, dramatically increases the Z-strength.

EXAMPLE III

Hand sheets were made up in a laboratory hand sheet former from various stocks made of 2.0 g of bleached soft wood sulfate pulp and 2.0 g of English china clay Grade C. The china clay was dispersed in an alkali stabilized colloidal silica sol diluted from 15% to 1.5% total solids by weight and the dispersion was added to the pulp in 500 ml of water in a laboratory disintegrator. A 2% solution of cationic starch (d.s.=0.03) was added and the resulting stock was transferred to a sheet mold. The hand sheets which were made were pressed and dried under substantially identical conditions.

During the runs different silica sols were used, the sols having differing surface areas per unit weight and stabilized with different molar ratios of alkali.

Sheets of the following compositions were made, all of which included in addition to the 2 g of pulp and 2 g of clay the amounts and type of sol and the amounts of cationic starch indicated. The properties of hand sheets produced are also set forth.

| | 1.5% sol g | Surface Area of $SiO_2$ $m^2/g$ | $SiO_2$ $Na_2O$ (molar ratio) | 2% CS g | Grammage $g/m^2$ | Density $kg/m^3$ | Tensile Index (Scan P16:76) | Elongation % | Ash % |
|---|---|---|---|---|---|---|---|---|---|
| 1 | 2.3 | 900 | 20 | 8.5 | 153 | 780 | 21.5 | 3.5 | 37 |
| 2 | 3.3 | 900 | 40 | 7.5 | 170 | 780 | 19.7 | 4.0 | 40 |
| 3 | 1.7 | 900 | 40 | 8.7 | 151 | 760 | 22.8 | 5.0 | 36 |
| 4 | 2.3 | 650 | 40 | 8.5 | 190 | 830 | 17.7 | 4.5 | 47 |
| 5 | 3.8 | 550 | 20 | 7.1 | 196 | 810 | 18.0 | 5.0 | 48 |
| 6 | 3.0 | 550 | 20 | 7.8 | 176 | 800 | 17.4 | 4.5 | 45 |
| 7 | 3.8 | 500 | 45 | 7.1 | 199 | 800 | 16.0 | 4.5 | 45 |
| 8 | 3.0 | 500 | 45 | 7.8 | 182 | 790 | 18.0 | 5.0 | 43 |
| 9 | 3.3 | 350 | 45* | 7.5 | 185 | 840 | 15.7 | 6.0 | 46 |
| 10 | 3.3 | 200 | 100 | 7.5 | 170 | 730 | 16.5 | 6.0 | 33 |
| 11 | 5.0 | 200 | 100 | 7.5 | 165 | 730 | 16.5 | 5.5 | 37 |
| 12 | 0 | — | — | 10.0 | 141 | 700 | 19.4 | 6.0 | 28 |
| 13 | No $SiO_2$, no cationic starch only 2.0 pulp + 6g china clay. | | | | 200 | 800 | 5.5 | 2.5 | 41 |

*Stabilized with ammonia instead of NaOH Molar Ratio = $\frac{SiO_2}{NH_3}$

From this example, it is aparent that the silica sol cationic starch complex greatly aids in the retention of clay, in many instances resulting in almost complete retention. Also, the above results show that maximum retention of the clay occurs when the colloidal silica particles have a size range such that the surface area is between about 300 and 700 $m^2/g$.

EXAMPLE IV

Hand sheets were made in a laboratory hand sheet former from a stock including a binder which includes as the colloidal silicic acid component a polysilic acid. 100 ml of water glass ($R=SiO_2:Na_2O=3.3$ and $SiO_2=26.5\%$ by weight) were diluted with 160 ml of water and slowly fed into 130 ml of 10% sulfuric acid under vigorous agitation. When all of the water glass had been added the pH was 2.7 and the $SiO_2$ content was 8% by weight. This acid sol was diluted to 2% $SiO_2$ by weight and added to English china clay Grade C followed by the addition of a 2% cationic starch (CS) solution (d.s. 0.03). The following suspensions were made.

| | Clay g | 2% sol g | 2% CS g |
|---|---|---|---|
| 1 | 2.0 | 5.2 | 9.0 |
| 2 | 2.0 | 4.4 | 7.4 |
| 3 | 2.0 | 4.4 | 7.4 |
| 4 | 2.0 | 2.9 | 7.1 |
| 5 | 2.0 | 2.9 | 7.1 |

Each of suspensions 1, 2 and 4 were fed into a laboratory disintegrator containing 2.0 g of bleached softwood sulfate pulp in 500 ml of water and thoroughly agitated. Suspensions 3 and 5 were stored for 5 hours before mixing as above. Immediately after mixing, hand sheets were made, pressed and dried. The sheets had the following characteristics.

| | Grammage g/m² | Tensile Index (Scan P16:76) | Elongation % | Ash Content % |
|---|---|---|---|---|
| 1 | 139 | 28.8 | 7.5 | 26 |
| 2 | 151 | 25.3 | 6.5 | 30 |
| 3 | 148 | 23.6 | 7.0 | 32 |
| 4 | 157 | 22.4 | 6.5 | 28 |
| 5 | 154 | 21.2 | 7.0 | 31 |

As compared with the samples produced in Example III, while the tensile index is improved, the retention of the mineral filler is not as great as in that Example.

EXAMPLE V

Hand sheets were made in a laboratory hand sheet former from various stocks as follows:

1. 2.0 g chalk having a particle size ranging from about 2 to 20 μm with the major portion being about 5 μm, 2.0 g of water and 3.8 g colloidal silica (1.5% total solids and surface area of 500 m²/g) are added to a stock consisting of 2.0 g fully bleached soft wood sulfate pulp and 500 ml of water in a laboratory disintegrator. To the chalk-silica-pulp stock 7.1 g cationic starch solution (2.0% total solids, d.s.=0.03) is added. A sheet is made from the sample in a laboratory sheet mold and the sheet is pressed and dried.

2. A sheet as in stock 1 above was made, except that the amount of colloidal silica sol was 5.7 g and the amount of cationic starch solution was 9.7 g.

3. A sheet as in stock 1 above was made, except that the amount of colloidal silica sol was 5.0 g and the amount of cationic starch solution was 10.3 g.

4. The same procedure was followed to make a reference sheet without chalk where 3.8 g of the colloidal silica sol were added to 2.0 g of the pulp in 500 ml of water and then 7.1 g of the cationic starch solution are added.

5. The same procedure was followed to make a reference sheet containing no binder. 10 g of chalk were added to 2.0 g of pulp in 500 ml of water, but no binder was added. The amount of chalk added was large so that, even with the poor retention observed, the mineral content in the final sheet would approximate that observed when the binder was employed.

6. Another sheet was made from a stock consistency of 2.0 g of the pulp in 500 ml of water with no additive.

The resulting paper had the following characteristics:

| | Sample No | | | | | |
|---|---|---|---|---|---|---|
| | 1 | 2 | 3 | 4 | 5 | 6 |
| Grammage g/m² | 192 | 201 | 200 | 110 | 174 | 100 |
| Density kg/m³ | 740 | 800 | 760 | 635 | 820 | 605 |
| Tensile Index SCAN P16:76 Nm/g | 16.0 | 20.0 | 17.3 | 50.7 | 10.5 | 31.4 |
| Elongation % | 7.5 | 5.5 | 4.0 | 5.5 | 6.0 | 7.5 |
| Ash Content % | 50 | 47 | 48 | 4 | 45 | 1 |

The foregoing demonstrates the increase in strength that results from the use of the binder of the invention both with and without mineral fillers and also demonstrates the increased retention which results from the use of the binder. From the amounts of binder employed relative to pulp it can be seen that substantially all of the mineral filler was retained in samples 1–3.

EXAMPLE VI

A slurry made of 2.0 g of Norwegian talc Grade IT Extra having a particle size ranging from about 1 to 5 μm, 8.0 g of water and 3.8 g of colloidal silica (1.5% total solids, specific surface area 480 m²/g) was added to a stock consisting of 2.0 g of fully bleached soft wood sulfate pulp and 500 g of water in a laboratory disintegrator. To the resulting stock 5.9 g of cationic starch (2.4% total solids, D.S.=0.033) were added. A sheet was made in a laboratory hand mold and was pressed and dried.

A reference sample was made where 4.0 g of the talc were added to 2.0 g of the pulp in 500 g of water, but no binder was added (The amount of talc is larger to compensate for the poor retention so that the finished sheet will have approximately the same mineral content as the sheet made above with the binder).

| | With binder | Without binder |
|---|---|---|
| Grammage, g/m² | 198 | 214 |
| Density, kg/m³ | 825 | 715 |
| Tensile Index SCAN P16:76, Nm/g | 16.5 | 3.1 |
| Elongation, % | 6.5 | 3.0 |
| Ash content, % | 48 | 51 |

It will be noted again, as in Example V, that the strength characteristics are markedly better as is the retention when the binder is employed with a talc mineral filler.

EXAMPLE VII

In this Example, the binder system of the present invention was added to different papermaking stocks to show that the invention is useful even in stocks containing considerable amounts of non-cellulosic fibers.

As cellulosic fibers fully bleached soft sulphate pulp was used, and as non-cellulosic fibers glass fibers having a diameter of about 5 μm and having been phenolic resin treated were used. The colloidal silica sol contained silica particles with a specific surface area of about 400 m²/g, and the silica content of the sol was originally 15% by weight, but the sol was diluted with water to a silica content of 1.5% by weight before it was used in the binder system. The cationic starch used had a degree of substitution of 0.02 and was used as a 2% by weight solution.

The following stocks were made, the stocks 1 to 3, inclusive, being comparative stocks:

| Stock | Cellulosic fibers g | Glass fibers g | Silica sol g | Cationic starch g | Ratio starch/sol |
|---|---|---|---|---|---|
| 1 | 1.6 | — | — | — | — |
| 2 | 1.6 | 0.3 | — | — | — |
| 3 | 1.6 | 0.3 | — | 1.12 | ∞ |
| 4 | 1.6 | 0.3 | 0.187 | 1.12 | 8 |
| 5 | 1.6 | 0.3 | 0.372 | 1.12 | 4 |
| 6 | 1.6 | 0.3 | 0.496 | 1.12 | 3 |
| 7 | 1.6 | 0.3 | 0.744 | 1.12 | 2 |

From the seven stocks, hand sheets were made in a laboratory hand sheet former, the resulting papers having the following characteristics:

| Paper from stock | Grammage g/m² | Density kg/m³ | Tensile index Nm/g | Z-strength (Scott Bond) | Elongation % |
|---|---|---|---|---|---|
| 1 | 68 | 650 | 55 | 135 | 9 |
| 2 | 91 | 530 | 33 | 84 | 11 |
| 3 | 88 | 520 | 40 | 120 | 10 |
| 4 | 90 | 520 | 44 | 132 | 10 |
| 5 | 85 | 520 | 44 | 138 | 11 |
| 6 | 94 | 540 | 48 | 152 | 12 |
| 7 | 93 | 550 | 47 | 149 | 11 |

As appears from the above, the Z-strength decreased when glass fibers were added (compare stocks 1 and 2) and then increased to about the initial value (compare stocks 1 and 4) when silica sol and cationic starch both were added. The sheets made from stocks 5, 6 and 7 had higher Z-strength values than the sheets made from stock 1 containing no glass fibers.

EXAMPLE VIII

This Example concerns the clarification of white water from a twin wire papermaking machine making wood-free coated paper. White water samples were taken from the normal production run of the papermaking machine and were analyzed for solids content and kinds of solids. The solids content was 7 grams/liter, and about 60% by weight of the solids consisted of china clay and chalk.

To the samples of white water different amounts of cationic starch and silica sol were added. The cationic starch having a degree of substitution of 0.033 was used as a solution containing 4% by weight of the starch. The colloidal silica sol had a particle size of about 6 nm, a specific surface area of about 500 m²/g and a silica concentration of 15% by weight.

In each test in the Table below, 500 ml of the white water were poured in a beaker and the indicated additions of silica sol and cationic starch were made. The contents of the beaker were vigorously agitated and the agitation then stopped. After the time lapse indicated, 20 ml turbidity test samples were taken by means of a pipette 5 mm below the surface of the contents in each beaker. The turbidity testing was performed according to Swedish Standard SIS in a turbidity tester (Hach model 2100A) giving the result in Formazin Turbidity Units (FTU). The lower the units, the better was the clarification obtained.

The additions to the white water samples and the test result appear from the Table below.

| Test | White water ml | 4% starch solution g | 15% silica sol g | Weight ratio R | Addition** (dry weight) % | Turbidity FTU after 15 s | 1 min | 5 min |
|---|---|---|---|---|---|---|---|---|
| 1 | 500 | — | — | | — | * | * | 900 |
| 2 | 500 | 1.75 | — | ∞ | 2 | * | * | 550 |
| 3 | 500 | 1.17 | 0.15 | 2 | 2 | * | 580 | 270 |
| 4 | 500 | 2.93 | 0.39 | 2 | 5 | * | 100 | 91 |
| 5 | 500 | 5.85 | 0.78 | 2 | 10 | 23 | 18 | 17 |

* = not measurable, more than 1000 FTU
** = the addition is calculated on the one hand on the dry weight of added cationic starch and added silica sol and, on the other hand, on the 3.5 grams of solids appearing in the 500 ml sample of white water.
R = weight ratio of cationic starch to silica sol The results presented in the Table of this Example demonstrate that the addition of the binder according to the present invention to white water results in a higher settling rate of the solids in the white water and thus in a decrease of turbidity. The results also show that an almost clear white water was obtained in test 5 which is a substantial improvement over the untreated white water in test 1.

As will be seen from the foregoing, the use of a colloidal silicic acid-cationic starch binder complex makes possible substantial economics in the papermaking process as well as a unique paper product. By using the binder system in connection with pulp stocks alone, the strength characteristics can be improved to the point that mechanical pulps can be substituted in substantial proportions for chemical pulps, while still maintaining the strength and other properties desired. On the other hand, if specific strength characteristics are required, the grammage to the sheet may be reduced while maintaining the desired properties.

Similarly, a mineral filler may be employed in much larger proportions than heretofore used while maintaining or even improving the characteristics and properties of the sheet. Or in the alternative the properties of a sheet containing filler may be enhanced.

In addition, the use of the binder system results in increased retention of both minerals and fines so that white water problems are minimized. As indicated, the system disclosed herein can also be used to advantage to agglomerate solids in white water to facilitate its disposal or reuse.

Further, because of the ability to reduce the grammage of a sheet or to increase the mineral content, it is possible to reduce the energy required to dry the paper and to pulp the wood fibers since less fibers can be employed.

In addition, the binder complex makes it possible to reduce the solids content of the white water and thus to reduce the environmental problems also in papermills not using the binder complex of this invention as an additive to the stock per se. The binder system thus improves the recovery of solids in the white water and improves the economy of the entire papermaking process.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. In a paper making process in which an aqueous papermaking stock containing a sufficient amount of cellulosic pulp to give a finished paper containing at least 50% cellulosic fiber is formed and dried, the improvement which comprises providing in the stock prior to the formation of the sheet a binder comprising colloidal silicic acid having an average particle size of less than 20 nm, and cationic starch having a degree of substitution of not less than 0.01, the weight ratio of cationic starch to $SiO_2$ being between 1:1 and 25:1, the solids in said binder amounting to 0.1–15% of the weight of said pulp, said cationic starch and said colloidal silicic acid being admixed with each other in the presence of cellulosic fiber to form a complex of cationic starch and colloidal silicic acid which serves as a binder for the cellulosic fibers.

2. The process of claim 1 wherein the pH of the stock is maintained between about 4 and 9.

3. The process of claim 1 wherein the weight ratio of cationic starch to $SiO_2$ is between 1.5:1 and 10:1.

4. The process of claim 3 wherein the solids in the binder amount to 1.0–15% of the weight of the pulp.

5. The process of claim 1 wherein the degree of substitution of the starch is from about 0.01 to about 0.05.

6. The process of claim 5 wherein the degree of substitution of the starch is from about 0.02 to about 0.04.

7. In a papermaking process in which an aqueous papermaking stock containing a sufficient amount of cellulosic pulp to give a paper containing at least 50 percent of cellulosic fiber is formed and dried, the improvement which comprises providing in the stock prior to the formation of the sheet a binder comprising a colloidal silica sol having silica particles having a surface area of about 50 to about 1000 $m^2/g$ and cationic starch having a degree of substitution of not less than 0.01, the weight ratio of cationic starch to $SiO_2$ being between 1:1 and 25:1, the solids in said binder amounting to 0.1–15% of the weight of said pulp, said cationic starch and said colloidal silica sol being admixed with each other in the presence of cellulosic fiber to form a complex of cationic starch and colloidal silica which serves as a binder for the cellulosic fibers.

8. The process of claim 7 wherein the pH of the stock is maintained between about 4 and 9.

9. The process of claim 8 wherein the weight ratio of cationic starch to $SiO_2$ is between 1.5:1 and 10:1.

10. The process of claim 7 wherein the solids in the binder amount to 1.0–15% of the weight of the pulp.

11. The process of claim 9 wherein the colloidal silica sol has silica particles having a surface area of between about 200 and about 1000 $m^2/g$.

12. The process of claim 11 wherein the colloidal silica sol has silica particles having a surface area of between about 300 and about 700 $m^2/g$.

13. The process of claim 11 wherein the cationic starch has a degree of substitution of about 0.01 to about 0.05.

14. In a papermaking process in which an aqueous papermaking stock containing a sufficient amount of cellulosic pulp to give a paper containing at least 50 percent of cellulosic fiber and a mineral filler material having at least partial anionic surface characteristics is formed and dried, the improvement which comprises providing in the stock prior to the formation of the sheet a binder comprising colloidal silicic acid having an average particle size of less than 20 nm and cationic starch having a degree of substitution of not less than 0.01, the weight ratio of cationic starch to $SiO_2$ being between 1:1 and 25:1, the solids in said binder amounting to from about 0.5–25% of the weight of said mineral filler material, said cationic starch and said colloidal silicic acid being admixed with each other in the presence of cellulosic fiber and mineral filler to form a complex of colloidal silicic acid and cationic starch which serves as a binder for the cellulosic fibers and mineral filler.

15. The process of claim 14 wherein the pH of the stock is maintained between 4 and 9.

16. The process of claim 14 wherein the weight ratio of cationic starch to $SiO_2$ is between 1.5:1 and 10:1.

17. The process of claim 14 wherein the solids in the binder amount to from about 2.5–15% by weight based upon the weight of the mineral filler.

18. The process of claim 17 wherein the colloidal silicic acid is added to and mixed with the mineral filler prior to incorporating the mineral filler into the stock and the cationic starch is mixed with the pulp and filler colloidal silicic acid mixture.

19. In a papermaking process in which an aqueous papermaking stock containing a sufficient amount of cellulosic pulp to provide a paper having at least 50 percent of cellulosic fiber and a mineral filler material having at least partial anionic surface characteristics is formed and dried, the improvement which comprises providing in the stock prior to the formation of the sheet a colloidal silica sol having silica particles having a surface area of about 50 to about 1000 $m^2/g$ and cationic starch having a degree of substitution of over about 0.01 to about 0.05, the weight ratio of cationic starch to $SiO_2$ being between 1:1 and 25:1, the solids in said binder amounting to from about 0.5–25% of the weight of said mineral filler material, said cationic starch and said colloidal silica sol being admixed with each other in the presence of cellulosic fibers and mineral filler to form a complex of colloidal silica and cationic starch which serves as a binder for said cellulosic fibers and mineral filler.

20. The process of claim 19 wherein the pH of the stock is maintained between 4 and 9.

21. The process of claim 20 wherein the weight ratio of cationic starch to $SiO_2$ is between 1.5:1 to 10:1.

22. The process of claim 21 wherein the solids in the binder amount to about 2.5–15% by weight based upon the weight of the mineral filler.

23. The process of claim 22 wherein the silica particles in the silica sol have a particle size of about 300 to 700 $m^2/g$.

24. An improved cellulosic paper product comprising at least 50 percent cellulosic fiber characterized by enhanced strength characteristics wherein the bond between cellulosic fibers is enhanced by a binder comprising a complex of colloidal silicic acid having an average particle size of less than 20 nm and cationic starch having a degree of substitution of over about 0.01 and wherein the ratio of cationic starch to $SiO_2$ is between 1:1 and 25:1, the solids in said binder amounting to 0.1–15% of the weight of the cellulosic fiber.

25. The product of claim 24 wherein the ratio of cationic starch to $SiO_2$ is 1.5:1 to 10:1.

26. An improved cellulosic paper product characterized by enhanced strength characteristics wherein the bond between cellulosic fiber is enhanced by a binder comprising a complex of a colloidal silica sol having silica particles having a surface area of about 50 to about 1000 $m^2/g$ and cationic starch having a degree of substitution of over about 0.01 and wherein the ratio of cationic starch to $SiO_2$ is between 1:1 and 25:1, the solids in said binder amounting to 0.1–15% of the weight of said cellulosic fiber.

27. The product of claim 26 wherein the ratio of cationic starch to $SiO_2$ is 1.5:1 to 10:1.

28. An improved cellulosic paper product containing at least 50 percent of cellulosic fiber, and a mineral filler having at least partial anionic surface characteristics wherein the bond between the cellulosic fibers and the mineral filler material is enhanced by a binder comprising a complex of a colloidal silicic acid having an average particle size of less than 20 nm and cationic starch having a degree of substitution of over about 0.01 and wherein the ratio of cationic starch to $SiO_2$ is between 1:1 and 25:1, the solids in said binder comprising 0.5–25% of the weight of said mineral filler material.

29. The product of claim 28 wherein the ratio of cationic starch to $SiO_2$ is 1.5:1 to 10:1.

30. The product of claim 28 wherein the binder complex comprises 0.1–15% of the weight of the cellulosic fiber.

31. The product of claim 28 wherein the solids in the binder complex amount to from about 2.5 to 15% by weight based upon the weight of the mineral filler.

32. An improved cellulosic paper product containing at least 50 percent cellulosic fiber, and a mineral filler having at least partial anionic surface characteristics wherein the bond between the cellulosic fibers and the mineral filler material is enhanced by a binder comprising a complex of colloidal silica sol having silica particles having a surface area of about 50 to about 1000 $m^2/g$ and cationic starch having a degree of substitution of over 0.01 and wherein the ratio of cationic starch to $SiO_2$ is between 1:1 and 25:1, the solids in said binder comprising 0.5–25% of the weight of said mineral filler material.

33. The product of claim 32 wherein the ratio of cationic starch to $SiO_2$ is 1.5:1 to 10:1.

34. The product of claim 32 wherein the binder complex comprises 0.1–15% of the weight of the cellulosic fiber.

35. The product of claim 32 wherein the solids in the binder complex amount to from about 2.5 to 15% dry weight based upon the weight of the mineral filler.

36. The product of claim 32 wherein the particle size of the $SiO_2$ particle has a surface area of from about 300 to about 700 $m^2/g$.

37. The process of claim 13 wherein the cationic starch has a degree of substitution of about 0.02 to about 0.04.

* * * * *

Disclaimer 4,388,150.—*Olof Sunden,* Thonon, France; *Per G. Batelson,* Lilla Edet; *Hans E. Johansson,* Kungalv; *Hans M. Larsson* and *Per J. Svending,* Gothenburg, Sweden. PAPERMAKING AND PRODUCTS MADE THEREBY. Patent dated June 14, 1983. Disclaimer filed June 23, 1983, by the assignee, *Eka Aktiebolag.*

The term of this patent subsequent to May 31, 2000, has been disclaimed.

[*Official Gazette August 16, 1983.*]

UNITED STATES PATENT AND TRADEMARK OFFICE

CERTIFICATE OF CORRECTION

PATENT NO. : 4,388,150
DATED : June 14, 1983
INVENTOR(S) : Olof SUNDEN et al.

It is certified that error appears in the above-identified patent and that said Letters Patent is hereby corrected as shown below:

After Column 18, Disclaimer: please delete "May 31, 2000" and insert therefor -- February 26, 2001--.

Signed and Sealed this
Fourteenth Day of March, 2000

*Attest:*

*Attesting Officer*

Q. TODD DICKINSON

*Commissioner of Patents and Trademarks*